United States Patent [19]

Kiseev et al.

[11] Patent Number: 4,467,861

[45] Date of Patent: Aug. 28, 1984

[54] HEAT-TRANSPORTING DEVICE

[75] Inventors: Valery M. Kiseev; Jury F. Maidanik; Jury F. Gerasimov, all of Sverdlovsk, U.S.S.R.

[73] Assignee: Otdel Fiziko-Tekhnicheskikh Problem Energetiki Uralskogo Nauchnogo Tsentra Akademii Nauk SSSR, U.S.S.R.

[21] Appl. No.: 432,788

[22] Filed: Oct. 4, 1982

[51] Int. Cl.[3] ..... F28D 15/00

[52] U.S. Cl. ..... 165/104.22; 165/104.26; 165/104.28; 417/208

[58] Field of Search ..... 165/104.22, 104.24, 165/104.26, 104.28, 104.29; 417/208, 209

[56] References Cited

FOREIGN PATENT DOCUMENTS 676849 7/1979 U.S.S.R. ..... 165/104.22

846980 7/1981 U.S.S.R. ..... 165/104.22

*Primary Examiner*—Albert W. Davis, Jr.

*Attorney, Agent, or Firm*—McAulay, Fields, Fisher, Goldstein & Nissen

[57] ABSTRACT

A heat-transporting device includes an evaporating chamber containing a coaxially-arranged evaporator in a capillary material soaked with a heat-transfer agent, said evaporator being in thermal contact with a source of heat and having an axial bore with a transverse partition in the capillary material, a vapor-jet pump serving to transform the dynamic pressure of the heat-transfer agent in the vapor phase into the static pressure of the heat-transfer agent in the liquid phase, and a heat-exchanging chamber. The evaporating chamber is provided with two end face cavities each bounded by the corresponding end face of the evaporator and walls of the chamber. The partition in the capillary material is located contiguously with that end face of the evaporator which faces the heat-exchanging chamber and is provided with through holes placing the end face cavities in communication with one another and is further provided with a diametrical passage, said passage being connected to a nozzle of the vapor-jet pump said nozzle being located in the partition and also to a vapor header which, in its turn, is connected to vapor outlets. Said outlets are provided in the form of longitudinal grooves cut in the outside surface of the evaporator between smooth annular collars which are present on the outside surface of the evaporator at the end faces thereof to prevent vapor leaks into the end face cavities. An outlet of a first conduit is located in the axial bore of the evaporator. A zone of the heat-exchanging chamber containing the heat-transfer agent with a lower heat content is connected to a suction side of the vapor-jet pump by way of the first conduit and another zone of said chamber containing the heat-transfer agent with a higher heat content is connected to a discharge side of said pump through a second conduit.

1 Claim, 3 Drawing Figures

HEAT-TRANSPORTING DEVICE

FIELD OF THE INVENTION

The present invention relates to heat technology and has specific reference to heat-transporting devices.

It may be used to advantage in cooling systems of the radio electronic equipment operating under the conditions of either an altering orientation in a field of body forces, the gravitational field including, or inertial loads of varying magnitude and direction.

BACKGROUND OF THE INVENTION

There are known effective heat-transporting devices, heat pipes in particular, consisting of sealed evacuated containers, mostly in metal, which are lined on the inside with a capillary material soaked with a fluid used as the heat-transfer agent.

An addition of heat to one end of the heat pipe causes the fluid to evaporate with the absorption of the heat of vaporization. The vapour so formed is induced by the pressure difference, no matter how small it may be, to flow towards the opposite end which is being cooled where condensation takes place, the heat of condensation being rejected into the surroundings through the wall of the pipe. The condensate absorbed by the capillary material reverses the direction of its flow due to the capillary pressure, returning into the zone of evaporation. The main equation describing the way the heat pipe is functioning is the pressure balance which may be thrown into the form $$\Delta P_c \geqq \Delta P_f + \Delta P_v \tag{1}$$

where $\Delta P_c$ is the capillary pressure, $N/m^2$; $\Delta P_f$ is the pressure difference in the fluid travelling through the capillary material, $N/m^2$; $\Delta P_v$ is the pressure difference of the vapour in the vapour circuit, $N/m^2$.

The pressure in capillary tubes of the cylindrical shape may be determined from Laplace's formula $$P_c = \frac{2\delta}{\tau_c} \cos \theta, \tag{2}$$

where $\delta$ is the surface tension, N/m; $\tau_c$ is the radius of a capillary tube, m; $\theta$ is the wetting angle at the solid-fluid interface, deg.

The above formula holds if the fluid-vapour interface in the zone of condensing is flat. In the case of capillary passages which have an intricate shape, use is made of an equivalent radius instead of the radius of the capillary.

The pressure difference causing the flow of the fluid through a capillary path with a radius $\tau_c$ may be described by the formula $$\Delta P_f = \frac{G 8 \eta L}{\pi r_c^4 \cdot \rho_f}, \tag{3}$$

where G is the mass flow rate of the fluid, kg/s; $\eta$ is the dynamic viscosity, $N \cdot s/m^2$; L is the actual length of the heat pipe, m; $\rho_f$ is the density of fluid, $kg/m^3$.

In the case of vapour flow, the pressure difference, $\Delta P_v$, may be determined by the same formula, provided the flow is a laminar one. However, the vapor flow is commonly of the turbulent type which calls for using a much more complex formula to calculate the value of $\Delta P_v$.

Equation (1) holds in the general case when the effect of the body forces on the heat-transfer agent in the heat pipe is negligible as, for example, when the pipe is oriented horizontally in the gravitational field and is of a small diameter.

When the heat pipe makes an angle $\psi$ with the horizontal, equation (1) must be supplemented by the term $\pm \rho_f g L \sin \psi$, where $\rho_f$ is the density of the fluid, $kg/m^3$; g is the acceleration of the free fall, $m/s^2$. Apparently, the additional term is used with the + sign when the zone of evaporating is located above the zone of condensing in the heat pipe and, as a consequence, the pressure loss therein appreciably increases with the increase in $\sin \psi$ and the length L. Therefore, the performance of heat pipes—the distance of heat transporting and the heat flux transported—is low, especially in the region of the working temperatures of radio electronic equipment which are relatively low and call for using low-temperature heat-transfer agents with a low surface tension—a factor controlling the capillary pressure.

To obtain in this case a requisite value of $\Delta P_c$, use must be made of capillaty materials with fine capillaries. However, it is evident from formula (3) that the friction losses increase directly as the radius of the capillary raised to the fourth power. All in all, the distance of heat transporting and the heat flux transported may grow so small when the flow of the heat-transfer agent is of a direction opposing the action of gravitational forces or any other body forces that the use of heat pipes may become questionable.

Known in the art is a heat pipe disclosed in U.S. Pat. No. 3,666,005. Said heat pipe comprises a number of sections connected to one another, each forming a heat pipe of its own. The section surfaces, including those at the ends of the heat pipe, are lined from the inside with a capillary material which is soaked with a heat-transfer agent. The sections are interlinked in such a way that the zone of condensing in a preceding section and the zone of evaporating in the succeeding one are separated by the same end face wall. Thus, the zone of condensing in a preceding section is in thermal contact with the zone of evaporating in the succeeding one. Since the heat-transfer agent circlates in each section independently of the other sections and the length of the section is comparatively short, the distance covered by the fluid agent making its path through the capillary material in each section is also short. Thus, this heat pipe is capable of transporting heat in an amount appreciably greater than the conventional heat pipe, using a capillary structure of a significant diameter, even if the gravitational forces are of a direction opposing the direction of the flow of the heat-transfer agent.

However, inherent in this pipe is a high heat resistance because of the heat exchange taking place between the sections due to heat conduction through the separating walls each having a heat resistance of its own.

Apparently, a requirement for a long heat pipe can be met by using a number of sections. Then, the total heat resistance of the heat pipe equalling the sum of the resistances of the separating walls will be high; in certain cases it may exceed the heat resistance of the conventional heat pipe. This will appreciably impair one of the assets of the known heat-transporting device, which is low heat resistance, so that the heat flux transported by the known heat pipe at a given temperature difference of the heat input and heat output will be lower than it is anticipated.

Efforts to increase the heat flux transported by a heat pipe through a reduction of the friction losses have materialized in a heat pipe disclosed in U.S. Pat. No. 3,543,839. The known heat pipe includes an evaporating chamber and a condensing chamber which contain capillary material and are interconnected by conduits into a closed air-tight circuit.

One of the conduits serves to convey vapour from the evaporating chamber, where it is formed due to a heat input, into the condensing chamber. Another conduit provides a liquid flow path for the condensate from the condensing chamber into the evaporating one, being filled to that end with a capillary material which is in contact with the same material contained in the chambers. A valve provided in the vapour flow path can control the friction loss in the conduit, functioning as a thermal switch which controls the heat flux in the heat pipe.

The heat pipe of said construction definitely cuts the losses of capillary pressure, for the liquid and vapour flows do not interact mechanically along the path of their travel. A thermal interaction of the two flows is practically also eliminated, which is a factor improving the thermodynamic characteristics of the heat pipe.

However, by analogy with the conventional heat pipes, the known pipe is not free from significant friction losses incurred due to the presence of the capillary material all the way down the conduit flowing over which is the condensate. Said losses appreciably reduce the distance of heat transporting and the heat flux transported if the heat pipe is so oriented in a field of body forces that the action of said forces or their components and the flow of the liquid heat-transfer agent are of opposite directions as this may be the case, for example, in the gravitational field when the evaporating chamber appears to be above the condensing one.

A further reduction of the friction loss along the liquid flow path has been achieved in the heat-transporting device disclosed in U.S.S.R. Inventor's Certificate No. 439,952.

The device includes an evaporating chamber containing a coaxially-arranged evaporator in a capillary material, which is in thermal contact with a source of heat, and a vapour-jet pump serving to transform the dynamic pressure of a heat-transfer agent in the vapour phase into the static pressure of the heat-transfer agent in the liquid phase. The evaporator has an axial bore with a transverse partition subdividing the evaporating chamber into two cavities, one containing the heat-transfer agent in the liquid phase and the other, in the vapour phase. A zone of a heat-exchanging chamber containing the heat-transfer agent in the liquid phase with a lower heat content is connected to a suction side of the vapour-jet pump by way of a first conduit and a zone of the heat-exchanging chamber containing the heat-transfer agent in the vapour phase with a higher heat content is connected to a discharge side of said pump and to the cavity of the evaporating chamber contained wherein is the heat-transfer agent in the liquid phase through a second conduit. A third conduit connects the cavity of the evaporating chamber containing the heat-transfer agent in the vapour phase to a nozzle of the vapour-jet pump. The capillary material of the evaporator is soaked with the liquid heat-transfer agent contained in one of the cavities of the evaporating chamber.

An addition of heat to the evaporating chamber results in the evaporation of the fluid the capillary material is soaked with. The vapour formed in the vapour cavity reaches the nozzle of the vapour-jet pump over the corresponding conduit. As the vapour is being issued from the nozzle, its dynamic head is transformed into the static pressure of the heat-transfer agent in the liquid phase, the pressure of the liquid phase at the discharge side increasing in excess of the pressure at the suction side at the same time. The so-called "pump effect" thus produced provides for an inflow of the heat-transfer agent with a lower heat content from the heat-exchanging chamber which causes condensation of the vapour emerging from the nozzle. The heat of condensation adds to the heat content of the heat-transfer agent which enters then the heat-exchanging chamber and the liquid phase cavity of the evaporating chamber.

Said device suffers from a number of significant drawbacks. Firstly, the heat-transfer agent heads for the surface of evaporation over the capillary material, the path being predominantly a longitudinal one. Therefore, any attempt to increase the length of the evaporator appears to be of no avail due to the same limitation as met with in the conventional heat pipe, which is capillary resistance. Secondly, difficulties are experienced in packaging the device due to the presence of an extra, third, conduit and the vapour-jet pump. Thirdly, the fact that the heat capacity of the inflow into the evaporating chamber is higher than that of the outflow from the heat-exchanging chamber causes a slight increase in the temperature of the vapour, as compared with the locale of heat rejection, and leads to a greater difference between the temperature of the locale of heat generation and that of the locale of heat rejection.

SUMMARY OF THE INVENTION

It is an object of the present invention to increase the capacity of a heat-transporting device by increasing the density of the heat flux reaching the evaporator from a source of heat.

Another object of the invention is to increase the capacity of a heat-transporting device by increasing the surface area of the evaporator without increasing the capillary resistance.

A further object of the invention is to provide a compact heat-transporting device.

In accordance with said and other objects, the essence of the present invention consists in that a heat-transporting device incorporating an evaporating chamber containing a coaxially-arranged evaporator in a capillary material soaked with a heat-transfer agent, said evaporator being in thermal contact with a source of heat and having an axial bore with a transverse partition in the capillary material, a vapour-jet pump serving to transform the dynamic pressure of the heat-transfer agent in the vapour phase into the static pressure of the heat-transfer agent in the liquid phase, and a heat-exchanging chamber, a zone whereof containing the heat-transfer agent with a lower heat content being connected to a suction side of the vapour-jet pump by way of a first conduit and another zone whereof containing the heat-transfer agent with a higher heat content being connected to a discharge side of said pump through a second conduit, according to the invention, the evaporating chamber has two end face cavities each bounded by the corresponding end face of the evaporator and the walls of the chamber, the partition is located contiguously with that end face of the evaporator which faces the heat-exchanging chamber and is provided with through holes placing the end face cavities in communication with one another and is further provided with a diametrical passage, said passage being connected to a nozzle of the vapour-jet pump—said nozzle being located in the partition—and also to a vapour header which, in its turn, is connected to vapour outlets in the form of longitudinal grooves cut in the outside surface of the evaporator between smooth annular collars provided at the outside surface of the evaporator next to the end faces thereof to prevent vapour leaks into the end face cavities; an outlet from the first conduit being located in the axial bore of the evaporator.

The heat-transporting device of said construction offers a number of advantages. Firstly, the flow of the heat-transfer agent towards the evaporating surface is predominantly a radial one achieved owing to the end face cavities, which are filled with the agent and connected to the axial bore of the evaporator, and a system of vapour outlets in the outside surface of the evaporator. The path through the capillary material covered by the heat-transfer agent is comparatively short so that it is possible to use a capillary structure with an effective radius which is sufficiently small in order to build up, according to formula (2), a high capillary pressure required to ensure the circulation of the heat-transfer agent without significantly increasing the friction losses of the device as a whole. The radial flow of the heat-transfer agent in the evaporator permits an increase in its length should a necessity arise to extend the surface area of the evaporator in order to cope with a certain thermal load.

Secondly, the vapour outlets in the form of longitudinal grooves out in the outside surface of the evaporator permit the heat-transfer agent to be fed directly to the warm wall of the evaporating chamber, which is in a thermal contact with the evaporator, and to remove the vapour without much loss of the capillary pressure, the extended surface of said vapour outlets and their large equivalent diameter facilitating the removal of the vapour. Said construction is also conducive to increasing the density of the heat flux applied to the evaporator, permitting an increase in the surface area thereof to cope with a given thermal load.

In spite of the presence of the vapour-jet pump which stirs up the circulation of the heat-transfer agent, boosting the capacity of the heat-transporting device, said layout of said device appears to be compact. This is achieved by locating the vapour-jet pump in the evaporating chamber and the pump nozzle, in the partition. Facilirating pump operation are the end face cavities. Firstly, they admit the heat-transfer agent which is expelled from the vapour outlets, header, diametrical passage, nozzle and is fed from the heat-exchanging chamber. Secondly, the end face cavities function as the suction side of the vapour-jet pump, being interconnected through the holes in the partition, and one of the cavities accomodates the discharge side of the pump.

Other objects and advantages of the invention will become obvious from a preferred embodiment thereof described by way of an example.

DETAILED DESCRIPTION OF THE INVENTION

Figure 2:
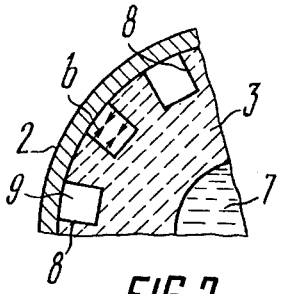
FIG. 2 is a fragmentary section on line II—II of FIG. 1 on an enlarged scale.
Figure 3:
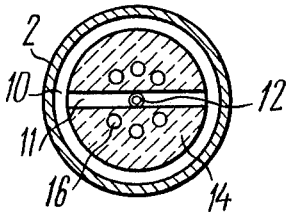
FIG. 3 is a section on line III—III of FIG. 1.

The heat-transporting device according to the invention incorporates an evaporating chamber I (FIG. 1) with a body 2 Said body is fitted with a coaxially-arranged evaporator 3 in a capillary material, e.g. cermet, which is in thermal contact with a source of heat shown by arrows a. The heat-transporting device has also a heat-exchanging chamber 4. The evaporating chamber I has two end face cavities 5 and 6 bounded by the walls of the chamber I and the corresponding end faces of the evaporator 3. The evaporator 3 is provided with an axial bore 7 serving to collect and feed, together with the end face cavities 5 and 6, the heat-transfer agent towards an evaporating surface 8 formed by the sides of vapour outlets 9 in the form of longitudinal grooves cut in the side surface of the evaporator 3 (FIG. 2). The vapour outlets 9 are connected to a vapour header 10 (FIG. 1) communicating with a diametrical passage II serving to admit the vapour flow shown by arrows b into a nozzle 12 a vapour-jet pump 13. The vapour header 10 (FIG. 3), the diametrical passage II and the nozzle 12 are located in a partition 14 of the evaporator 3 which is arranged contiguously with the end face of the evaporator 3, facing the heat-exchanging chamber 4. The discharge side 15 (FIG. 1) of the vapour-jet pump 13 is located in the end face cavity 6 which, in its turn, forms the suction side of said pump 13 together with the end face cavity 5 and the axial bore 7, the end face cavities 5 and 6 being connected to that end to one another through the axial bore 7 and holes 16 (FIG. 3) piercing the partition 14.

The heat-exchanging chamber 4 is essentially a tube-type heat exchanger a zone whereof containing the heat-transfer agent with a higher heat content is provided in the form of a header 17 and another zone whereof containing the heat-transfer agent with a lower heat content is provided in the form of a header 18. The header 17 is connected to the header 18 by a multitude of heat-exchange tubes 19. The heat-exchanging chamber 4 of the heat-transporting device is intended to reject the heat shown by arrows c to an external medium which may be, for example, the surrounding air.

The header 18 is connected to the suction side of the vapour-jet pump 13 over a first conduit 20, and the header 17 is connected to the discharge side 15 of the pump 13 through a second conduit 21.

To prevent vapour leaks from the vapour outlets 9 into the end face cavities 5 and 6, smooth annular collars 22 are provided at the outside surface of the evaporator 3 near the end faces thereof.

To feed the heat-transfer agent with a lower heat content into the suction side of the vapour-jet pump 13, an outlet 23 from the first conduit 20 is located in the axial bore 7 of the evaporator 3.

The direction of the liquid phase flow is indicated by arrows d.

The heat-transporting device operates on the following lines.

When heat is being added to the evaporator 3 from an external source as shown by arrows a (FIG. 1), the heat-transfer agent the capillary material of the evaporator is soaked with evaporates from the surfaces 8 of the vapour outlets 9 (arrows b in FIG. 2), absorbing the latent heat of vaporization. The vapour formed (arrows b) in the vapour outlets 9 leaves into the vapour header 10 and reaches the nozzle 12 of the vapour-jet pump 13 through the diametrical passage II, expelling the heat-transfer agent in the liquid phase contained therein into the end face cavity 5. The volume of the cavity 5 must be greater than that of the heat-transfer agent expelled. Vapour leaks into the end face cavities 5, 6 and the axial bore 7, bypassing the nozzle 12 of the vapour-jet pump 13, are eliminated owing to the smooth annular collars 22 tightly fitting the inside surface of the body 2 of the evaporating chamber I and functioning as seals and also because of the capillary force acting upon the liquid heat-transfer agent present in the capillary structure of the evaporator 3.

The vapour (shown by arrows b) issuing from the nozzle 12 condenses on contact with the heat-transfer agent in the liquid phase, and the flow of the condensed vapour thus formed interchanges pulses with the flow of the heat-transfer agent having a lower heat content which reaches the suction side of the vapour-jet pump 13 from the heat-exchanging chamber 4 through the outlet 23 of the conduit 20 and the holes 16 in the partition 14. The heat of condensation liberated at this stage increases the heat content of the heat transfer agent in the liquid phase, and the interchange of pulses between the flows of the vapour phase and liquid phase causes the dynamic pressure of the vapour to become transformed into the static pressure of the liquid heat-transfer agent present in the discharge side 15 of the vapour-jet pump 13. The resulting pump effect induces the heat-transfer agent circulation through the heat-transporting device. The heat-transfer agent having a higher heat content flows into the header 17 of the heat-exchanging chamber 4 through the conduit 21, entering hence the tubes 19 constituting a heat exchanging surface of considerable extent. While flowing through the tubes 19, the heat-transfer agent rejects some of its heat (shown by arrows c) into the surrounding medium The heat-transfer agent with a lower heat content enters the header 18, being then induced by said pump effect to reach the axial bore 7 of the evaporator 3 and the end face cavity 5. Here, some of the heat-transfer agent becomes absorbed by the capillary material of the evaporator 3 and reaches the evaporating surface 8 thereof under the action of the capillary forces and the rest of the heat-transfer agent (shown by arrows d) enters the end face cavity 6 through the holes 16, being thence fed into the discharge side 15 of the vapour-jet pump 13. Next, the process of circulation of the heat-transfer agent is repeated.

In the disclosed heat-transporting device, the capillary evaporator 3 functions as a vapour generator feeding the vapour-jet pump 13 which caters for the circulation of the heat-transfer agent. Apparently, by analogy with the conventional heat pipe, the total loss of pressure along the paths of the liquid and vapour flow, determined by formula (1), cannot be higher than the capillary pressure in the capillary structure of the evaporator 3 which is decided by formula (2). However, in the disclosed device filled with the heat-transfer agent almost up to the brim, the pressure balance is affected but little by the orientation of the device in the gravitational field. This is because of a practically nonexisting unbalanced head of liquid so that the term $\rho_l gL \sin \psi$, taking account of static pressure loss, can be omitted.

The fact that the friction losses in the conduits 20, 21 and in the heat-exchanging chamber 4 are low and the distance covered by the heat-transfer agent in the capillary material of the evaporator 3 is short creates the prospect of reducing the equivalent radius of the capillary structure and building up a high capillary pressure even if in use is a low-temperature heat-transfer agent with a low surface tension. Consequently, appreciable heat fluxes can be transported over a distance of a few meters whatever is the orientation of the device in the field of body forces. Furthermore, the radial pattern of the feed of the heat-transfer agent to the evaporating surface 8 permits lengthening of the capillary evaporator, if such necessity arises, without a significant increase in pressure losses.

Other features of design such as the compactness of the vapour-jet pump 13, location thereof in the body 2 of the evaporating chamber I and a minimum number of the conduits circulating wherethrough is the heat-transfer agent render the disclosed device compact.

Figure 1:
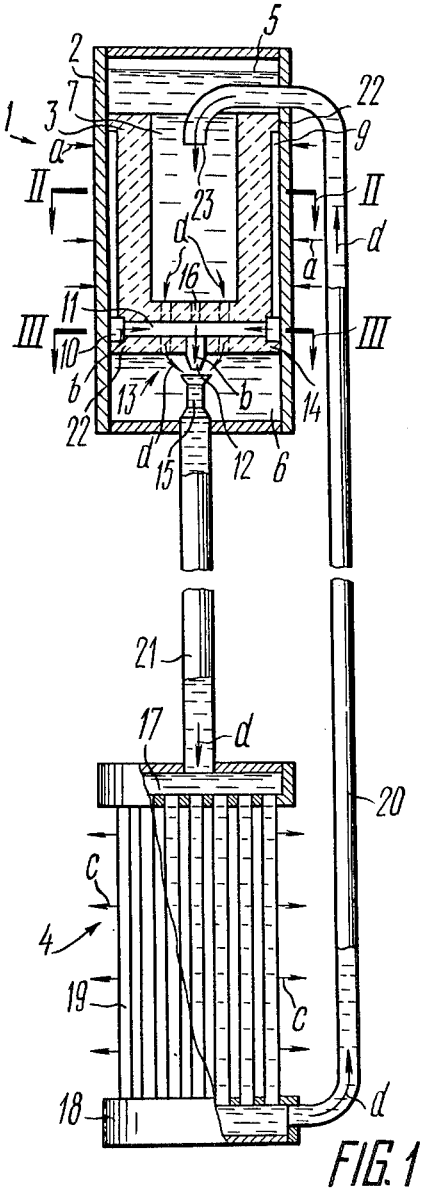
FIG. 1 is a schematic sectional elevation of the heat-transporting device according to the invention.

The heat-transporting device in accordance with the invention having a length of 1.5 meters and operating on water as the heat-transfer agent has appeared to be capable of producing in the vertical orientation as shown in FIG. 1 a heat flux of 150 $kW/m^2$ at the surface of the evaporating chamber at a steam temperature of 370K. The average difference between the temperatures at the surface of the evaporating chamber and that of the heat-exchanging chamber has amounted to 63K. An increase in the length of the device up to 3.2 meters has produced a heat flux of 90 $kW/m^2$, other things being equal. A point to be noted is that said values of the heat flux are not the ultimate ones.

What is claimed is:

1. A heat-transporting device comprising:

an evaporating chamber evaporated wherein is a heat-transfer agent;

an evaporator in a capillary material soaked with said heat-transfer agent, said evaporator being in thermal contact with a source of heat and being arranged in said evaporating chamber coaxially therewith;

an axial bore provided in said evaporator to feed the heat-transfer agent thereto;

a vapor-jet pump for transforming the dynamic pressure of the heat-transfer agent in the vapor phase into the static pressure of the heat-transfer agent in the liquid phase;

a suction side of said vapor-jet pump;

a discharge side of said vapor-jet pump;

a heat-exchanging chamber for rejecting the heat of the heat-transfer agent in the liquid phase into the surrounding medium;

a first conduit connecting a zone of said heat-exchanging chamber contained wherein is the heat-transfer agent with a lower heat content to said suction side of said vapor-jet pump;

an outlet of said first conduit located in said axial bore of said evaporator;

a second conduit connecting a zone of said heat-exchanging chamber contained wherein is the heat-transfer agent with a higher heat content to said discharge side of said vapor-jet pump;

two end face cavities for the heat-transfer agent in the liquid phase, said end face cavities serving as said suction side of said vapor-jet pump;

an end face of said evaporator;

another end face surface of said evaporator;

one of said two end face cavities is bounded by an end face surface of said evaporator and walls of said evaporating chamber;

the other of said two end face cavities is bounded by the other end face surface of said evaporator and said walls of said evaporating chamber;

a transverse partition in capillary material, said partition being located contiguously with the other said end face surface of said evaporator facing said heat-exchanging chamber; said partition being provided with through holes placing said two end face cavities into communication with one another and being also provided with a diametrical passage;

a nozzle of said vapor-jet pump serving to form a jet of the heat-transfer agent in the vapor phase, said nozzle being located in said transverse partition and communicating with said diametrical passage;

two smooth annular collars of the cylindrical shape serving to prevent vapor leaks into said two end face cavities, said collars being provided at the outside surface of said evaporator next to the end faces thereof;

a vapor header provided in said partition and connect to said diametrical passage;

vapor outlets provided in the form of longitudinal grooves out in the outside surface of said evaporator, said outlets being connected to said vapor header and extending between said two smooth annular collars of the cylindrical shape.

* * * * *